United States Patent [19]

Praeg

[11] Patent Number: 4,993,477

[45] Date of Patent: Feb. 19, 1991

[54] MOLTEN METAL FEED SYSTEM CONTROLLED WITH A TRAVELING MAGNETIC FIELD

[75] Inventor: Walter F. Praeg, Palos Park, Ill.

[73] Assignee: The United States of America as represented by the United States Department of Energy, Washington, D.C.

[21] Appl. No.: 318,875

[22] Filed: Mar. 6, 1989

[51] Int. Cl.[5] ..... B22D 11/10; B22D 11/16

[52] U.S. Cl. ..... 164/453; 164/466; 164/468; 164/504; 164/155

[58] Field of Search ..... 164/453, 155, 449, 466, 164/468, 502, 504, 483

[56] References Cited

U.S. PATENT DOCUMENTS

| | | | |
|---|---|---|---|
| 3,263,283 | 8/1966 | Allard | 164/466 |
| 3,463,365 | 8/1969 | Dumont-Fillon | 164/453 |
| 3,486,660 | 12/1969 | Heintz | 164/453 |
| 3,776,439 | 12/1973 | Settle | 164/502 |
| 4,615,376 | 10/1986 | Mori et al. | 164/453 |

FOREIGN PATENT DOCUMENTS

| | | | |
|---|---|---|---|
| 7521075 | 7/1975 | France . | |
| 60-99458 | 6/1985 | Japan | 164/453 |
| 573254 | 9/1977 | U.S.S.R. | 164/453 |
| 2204516 | 11/1988 | United Kingdom | 164/502 |

*Primary Examiner*—Richard K. Seidel

*Attorney, Agent, or Firm*—Helen S. Cordell; John M. Albrecht; William R. Moser

[57] ABSTRACT

A continuous metal casting system in which the feed of molten metal is controlled by means of a linear induction motor capable of producing a magnetic traveling wave in a duct that connects a reservoir of molten metal to a caster. The linear induction motor produces a traveling magnetic wave in the duct in opposition to the pressure exerted by the head of molten metal in the reservoir so that $$p_c = p_g - p_m$$

where $p_c$ is the desired pressure in the caster, $p_g$ is the gravitational pressure in the duct exerted by the force of the head of molten metal in the reservoir, and $p_m$ is the electromagnetic pressure exerted by the force of the magnetic field traveling wave produced by the linear induction motor. The invention also includes feedback loops to the linear induction motor to control the casting pressure in response to measured characteristics of the metal being cast.

8 Claims, 8 Drawing Sheets

EXAMPLE OF CONTROLLED START-UP TRANSIENT

CASTING PRESSURES (SPEEDS) 1 THROUGH 4 ARE OBTAINED BY MECHANICAL MEANS (ORIFICES, DAMS, WEIRS, ETC.)

PRESSURE PROFILES OF MECHANICALLY CONTROLLED TUNDISH DISCHARGE

PRESSURE PROFILES OF ELECTROMAGNETICAL CONTROLLED TUNDISH DISCHARGE

FIG. 7 Control via One Wide-Band Feedback Loop

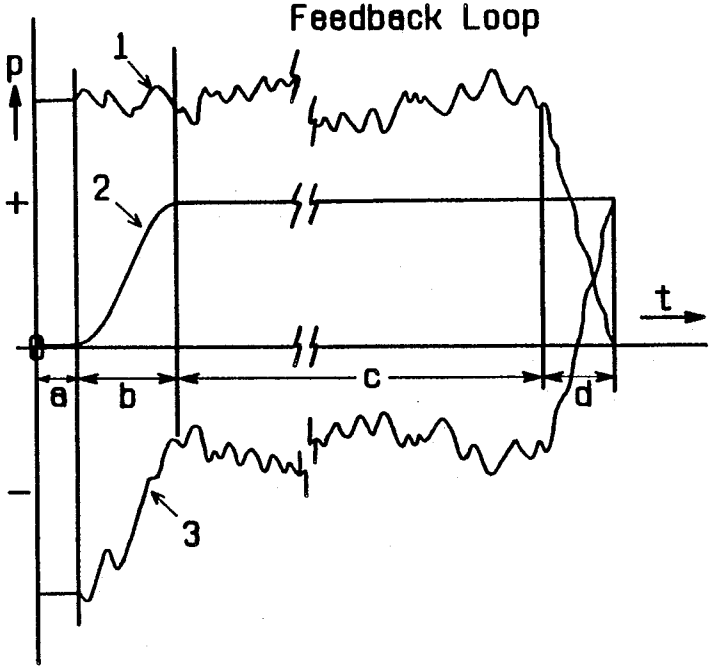

FIG. 8 Control via Two Feedback Loops

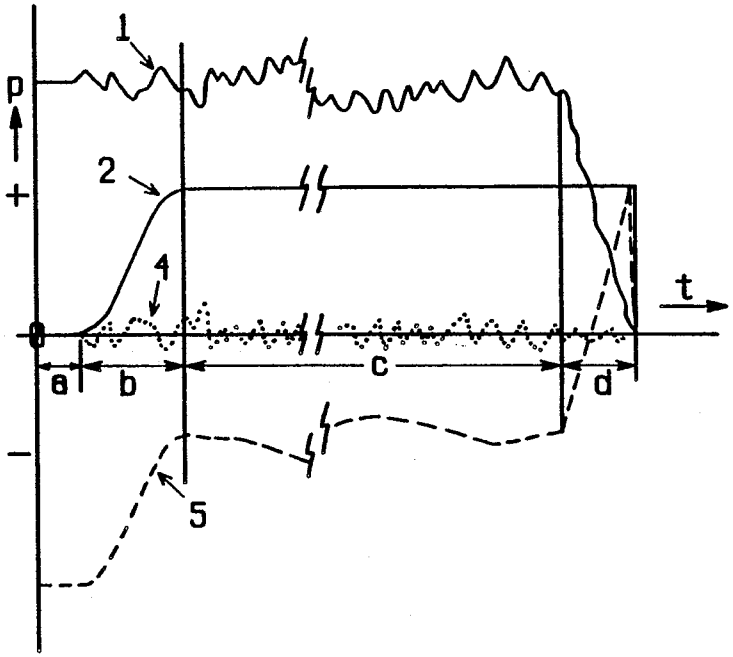

a: LIM serves as shut-off valve prior to start-up b: start-up
c: continuous casting d: final stage of casting; tundish is discharging
1. gravitational pressure, $p_g$, and distortions of metal in tundish
2. desired (programmed) casting pressure, $p_c = p_g + p_m$, as controlled from reference via feedback loops
3. magnetic pressure, $p_m$, produced by traveling wave in wide-band feedback loop
4. magnetic pressure produced by high frequency feedback loop to LIM to LIM
5. magnetic pressure produced by low-frequency feedback loop to LIM

MOLTEN METAL FEED SYSTEM CONTROLLED WITH A TRAVELING MAGNETIC FIELD

CONTRACTUAL ORIGIN OF THE INVENTION

The United States Government has rights in this invention under Contract No. W-31-109-ENG-38 between the U.S. Department of Energy and the University of Chicago, operator of Argonne National Laboratory.

BACKGROUND OF THE INVENTION

This invention relates generally to regulating the flow of molten metal by electromagnetism and is particularly directed to controlling the flow of molten metal in an electromagnetic process for continuous casting of steel.

Steel making occupies a central economic role and represents a significant fraction of the energy consumption of many industrialized nations. The bulk of steel making operations involves the production of steel plate and sheet. Present steel mill practice typically produces thin steel sheets by pouring liquid steel into a mold, whereupon the liquid steel solidifies upon contact with the cold mold surface. The solidified steel leaves the mold either as an ingot or as a continuous thick slab after it is cooled typically by water circulating within the mold wall during a solidification process. In either case, the solid steel is relatively thick, e.g., 6 inches or greater, and must be subsequently processed to reduce the thickness to the desired value and to improve metallurgical properties. The mold formed steel is usually characterized by a surface roughened by defects, such as cold folds, liquation, hot tears and the like which result primarily from contact between the mold and the solidifying metallic shell. In addition, the steel ingot or slab thus cast also frequently exhibits considerable alloy segregation in its surface zone due to the initial cooling of the metal surface from the direct application of a coolant. Subsequent fabrication steps, such as rolling, extruding, forging and the like, usually require the scalping of the ingot or slab prior to working to remove both the surface defects as well as the alloy deficient zone adjacent to its surface. These additional steps, of course, increase the complexity and expense of steel production.

Steel slab thickness reduction is accomplished by a rolling mill which is very capital intensive and consumes large amounts of energy. The rolling process therefore contributes substantially to the cost of the steel sheet. In a typical installation, a 10 inch thick steel slab may be manipulated by ten rolling machines before it reaches its commercial thickness. The rolling mill may extend as much as one-half mile and cost as much as $500 million.

Another approach to forming thin metal sheets involves casting into approximately the final desired shape. Compared to current practice, a large reduction in steel sheet total cost and in the energy required for its production could be achieved if the sheets could be cast in near net shape, i.e. in shape and size closely approximating the final desired product. This would reduce the rolling mill operation and would result in a large savings in energy. There are several technologies currently under development which attempt to achieve these advantages by forming the steel sheets in the casting process. Some of the approaches use electromagnetic fields on one or both sides of the liquid metal sheet to confine the sheet as it solidifies in a continuous process.

Systems that employ magnetic fields as a substitute for a mechanical mold wall to confine a molten metal in a continuous casting process include U.S. Pat. No. 4,678,024, "Horizontal Electromagnetic Casting of Thin Metal Sheets", by Hull et al., issued July 7, 1987; U.S. Pat. No. 4,905,756, "Electromagnetic Confinement and Movement of Thin Sheets of Molten Metal" by Lari et al., issued Mar. 6, 1990; U.S. Pat. No. 4,936,374, "Sidewall Containment of Liquid Metal with Horizontal Alternating Magnetic Fields" by Praeg, issued June 26, 1990; and copending applications: "Sidewall Containment of Liquid Metal with Vertical Alternating Magnetic Fields" by Lari et al., Ser. No. 408, 418, Notice of Allowability dated June 15, 1990, continuation of Ser. No. 207,818, now abandoned; and "Electromagnetic Confinement for Vertical Casting or Containing Molten Metal" by Lari et al., Ser. No. 257,387, Notice of Allowability dated July 10, 1990.

These continuous casting processes include a feed system that continuously introduces metal in liquid form to the electromagnetic casting process. The feed system includes a tundish or reservoir for the molten metal from which the molten metal flows via a nozzle to the electromagnetic caster. The molten metal can flow from the tundish through the nozzle by gravity. As part of the electromagnetic casting processes, it can be necessary or advantageous to be able to precisely control the flow of molten metal from the tundish and to vary the flow rate to account for start-up or shut-down conditions. Also, control of the flow can be incorporated into a feedback system to exercise precise and accurate control over the casting process to insure a high quality product. To accomplish this it is necessary to control the flow of molten steel from the tundish within a narrow operating range and to be able to precisely modify it in response to feedback signals. The design for the feed system would include the following factors: (1) casting start-up transients must be closely controlled; (2) during casting, the fluid volume flow rate must equal the casting speed; (3) changes in ferrostatic pressure ($p_g=\rho gh$, where $\rho$=fluid density, g=acceleration due to gravity, and h=effective vertical height of the molten steel) must not have a detrimental effect on the electromagnetic continuous caster; (4) the cross-section of the molten metal stream emerging from the feed system must be approximately that of the desired product (i.e., a rectangular sheet having a relatively large aspect ratio).

One of the reasons that a flow control system has such significance in the continuous casting process is that the weight of the molten steel exerts such high pressure in the casting system. For example, with steel the ferrostatic pressure of an effective height of only 5.1 cm can produce a casting speed of 1 $ms^{-1}$. A height variation of only 0.1 cm (0.039 inches) results in a 1% speed variation. The speed of 1 $ms^{-1}$ is reached in 0.1 second if the gate of the feed system is opened abruptly. Controlling the flow by mechanical means only (adjustable orifices, dams, or weirs) can be difficult especially if one has to compensate for the changing level of molten steel in the tundish and for build-up or erosion in the nozzle. Accordingly, there is a need for a control device that overcomes these problems associated with mechanical feed systems.

The present invention has particular application to use in a continuous casting system that uses electromagnetic fields to confine a molten metal as it solidifies. However, the present invention could also be used in continuous casting systems that do not employ electromagnetic fields to confine the molten metal. This invention can be utilized wherever it is necessary to carefully regulate the flow of molten metal.

Accordingly, an object of this invention is the production of a precisely controlled flow of molten metal into a caster during start-up, during continuous operation, during shut-off and during shut-down.

Another object of this invention is the precise control of molten metal in a continuous casting process in the presence of mechanical disturbances caused by start-up transients, metal being poured from the ladle into the tundish (e.g. turbulence, ripples, changes in flow pattern, etc.), or wear and tear on orifices, dams, or weirs used to mechanically control the metal flow.

A further object of this invention is to supplement a mechanical molten metal feed system with an electromagnetic system that controls the fluid flow with a traveling electromagnetic field.

A still further object of this invention is to control a mechanical molten metal feed system with an electromagnetic system that regulates the molten metal flow with a traveling electromagnetic field via feedback loops that include sensors responsive to the casting speed, ferrostatic pressure, casting sheet thickness, temperature or spatial location of a solid metal sheet as it emerges from the caster.

A yet still further object of this invention is the electromagnetic control of molten metal flow into a caster that can cast horizontally, vertically, or in a slanted direction by means of a traveling electromagnetic wave produced by a magnet arranged around a duct coupled to the nozzle of a tundish that feeds the caster.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing, and other objects, the present disclosure provides an apparatus and method for controlling with precision the flow of molten metal in a continuous casting process. According to the present invention, a linear induction motor is located around a duct connecting a supply reservoir of molten metal to a caster. The linear induction motor can produce a traveling magnetic wave that operates on the molten metal in the duct. Working in conjunction with the ferrostatic pressure produced by the head of molten metal in the reservoir and with feedback loops responsive to such factors as casting speed, the linear induction motor can achieve precision feed control for the molten metal as well as provide a start-up, shut-off, and shut-down mechanism for continuous metal casting.

BRIEF DESCRIPTION OF THE DRAWINGS

FIG. 7 is a graph of pressure control with one wide-bank feedback loop.

FIG. 8 is a graph of pressure control with two feedback loops.

DETAILED DESCRIPTION OF THE INVENTION

The present invention is used in conjunction with a gravity feed system that conveys molten metal from a storage reservoir to the location where casting of the metal takes place. The present invention controls the feed of molten metal with an electromagnetic system that regulates the molten metal with a traveling electromagnetic field produced by a linear induction motor arranged around a section of duct leading from the storage reservoir. In this arrangement, the ferrostatic pressure $p_g$ produced by the head of molten metal in the reservoir is larger than the pressure $p_c$ that is required for the desired casting speed. The pressure difference $p_m = p_g - p_c$ is produced by the traveling electromagnetic field in response to a feedback loop controlled from a programmable reference.

Figure 1A:
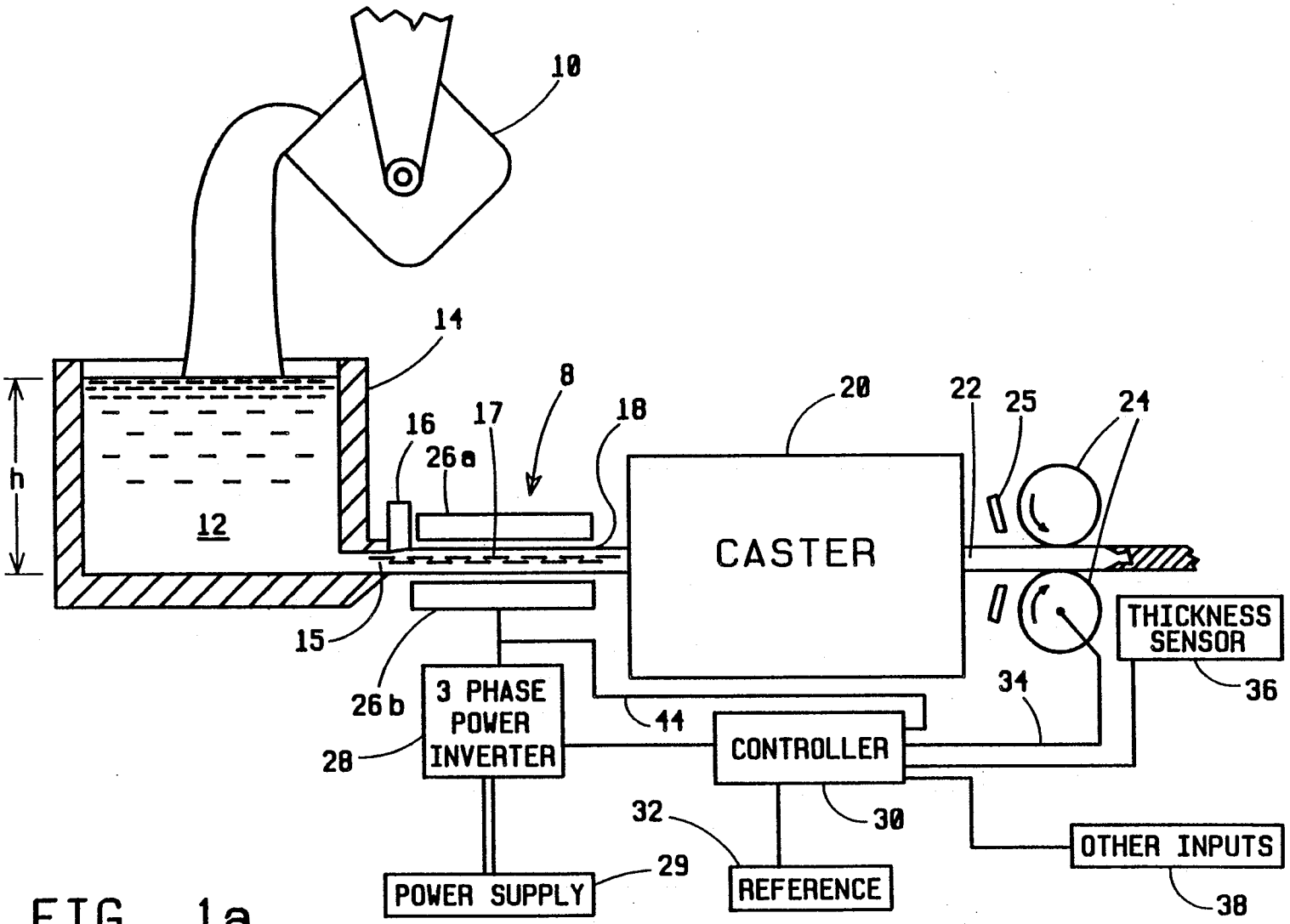
FIG. 1*a* depicts the present invention incorporated into a system for the continuous casting of metal sheets.

FIG. 1*a* illustrates the components of a continuous casting system using the present invention to regulate the feed rate. Ladle 10 pours molten metal 12 into the tundish 14 at a location as far away from the nozzle 15 as practicable to reduce turbulence. A gate 16 acts as a valve controlling the flow. The maximum flow pressure is proportional to the effective height h, of the liquid metal 12 in the tundish 14. Molten metal 17 emerges from nozzle 15 into rectangular containment duct 18. A portion of containment duct 18 is enclosed by an electromagnetic linear induction motor 8 (LIM) that produces magnetic pressure on the liquid metal 17.

From the containment duct 18, the molten metal sheet enters the caster 20. In caster 20 the molten metal sheet is cooled and solidified. The now solid metal sheet 22 exists caster 20 where it is supported and carried away by a support means, such as support rollers 24. The solid sheet 22 may be further cooled by jets 25 that can spray water or gas on the sheet 22 after it emerges from caster 20.

Figure 2:
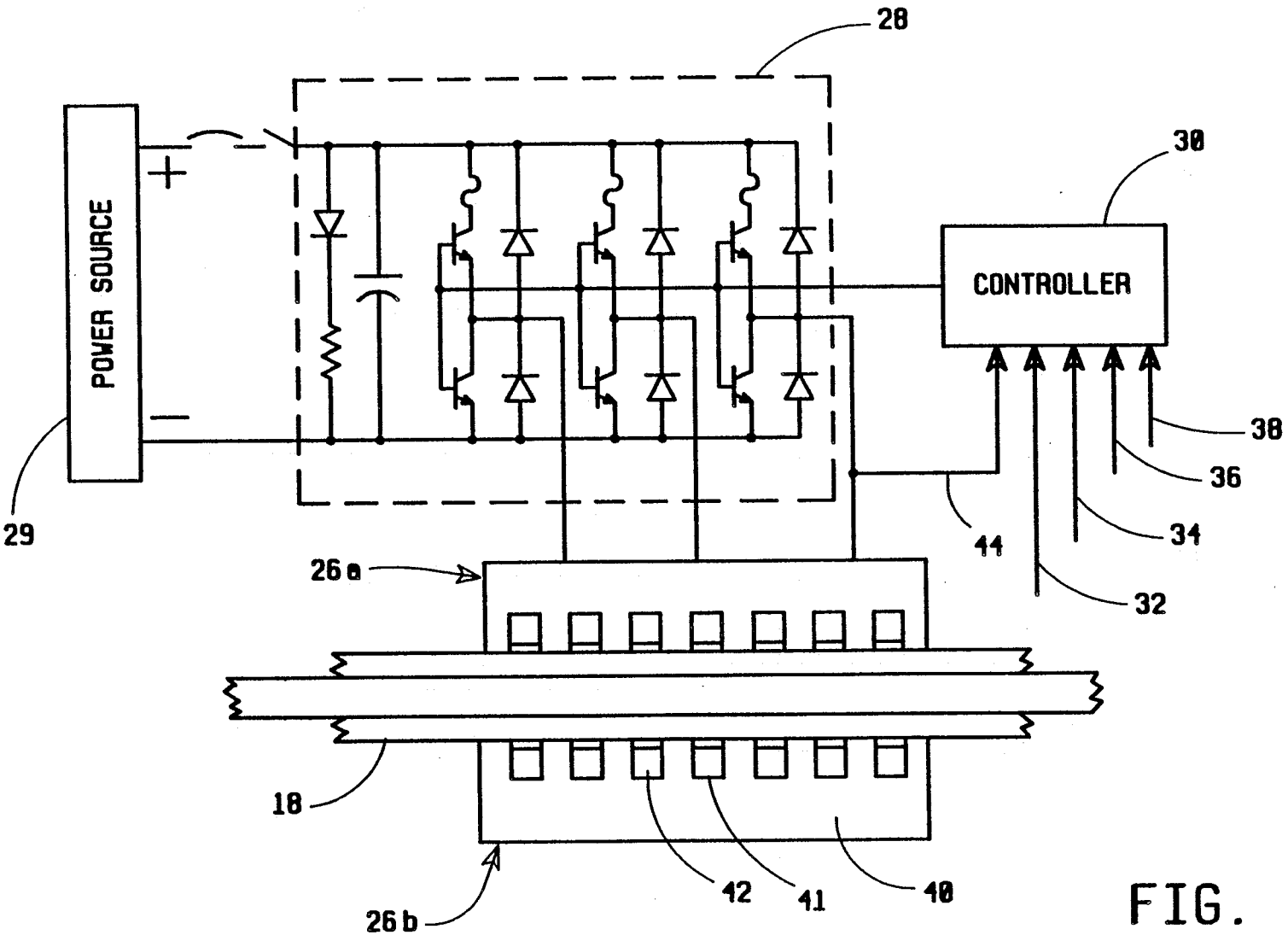
FIG. 2 is a cross-sectional view of the stators of the present invention and also includes a block diagram for the inverter.

FIG. 2 shows the components that comprise the feed control system. Referring to FIG. 2, there is depicted a sectional view of the two stators 26*a* and 26*b*. The stators 26*a* and 26*b* are placed on opposite sides outside of containment duct 18. The stators 26*a* and 26*b* receive current from a three phase power inverter 28. Inverter 28 receives power from supply 29. The stators 26*a* and 26*b* are connected to inverter 28 so that the fields produced are additive. Controller 30 regulates operation of the inverter 28 based upon reference input 32 and feedback inputs such as casting speed input 34 from the support rollers 24 and other sensor inputs such as 36 for sheet thickness, inverter output 44 and other inputs 38 for temperature, finish quality, etc.

The stators 26a and 26b include a core section 40 which may be made of a ferromagnetic material such as laminated steel. Slots 41 are located in core sections 40 on the sides closest to duct 18. Three-phase field windings 42 are embedded in slots 41 of cores 40. The LIM drive employs a pulse-width-modulated three-phase inverter 28 of a frequency and power range suitable for the application. Waveform generation, inverter control, and system protection are achieved by the controller 30 which includes a microprocessor. The controller 30 determines the correct voltage and frequency to apply to the LIM thereby providing a braking or acceleration force to the molten steel.

The stators 26a and 26b have a structure similar to that of a motor except that the windings are distributed in a flat linear structure rather than in a cylindrical magnetic structure; hence, they are referred to as linear induction motors (LIM). The basic principle of operation of the linear induction electromagnetic motor (a LIM pump) used in this invention is the same as that of a polyphase, squirrel cage induction motor. In an induction motor, a moving magnetic field is produced by a distributed polyphase winding, wound on the inner periphery of a cylindrical magnetic structure (stator). The rotating field induces a voltage in conductors imbedded in the outer periphery of a second cylindrical magnetic structure (rotor). Interaction between the magnetic field and the currents resulting from induced voltages produces a force on the magnetic structure of the rotor. Since the configuration is cylindrical, these forces produce a torque on the rotor. In the LIM pump the structure is linear instead of cylindrical. Accordingly, the moving magnetic field travels in a straight line instead of in a circular path. The LIM pump can be used to move metal in a direction just as a motor can be used to rotate a rotor. Instead of a rotor as in a motor the LIM exerts a force that can pump the conducting fluid 17 confined in rectangular containment duct 18. The rectangular containment duct 18 is made of nonconducting and nonmagnetic refractor material.

Figure 3:
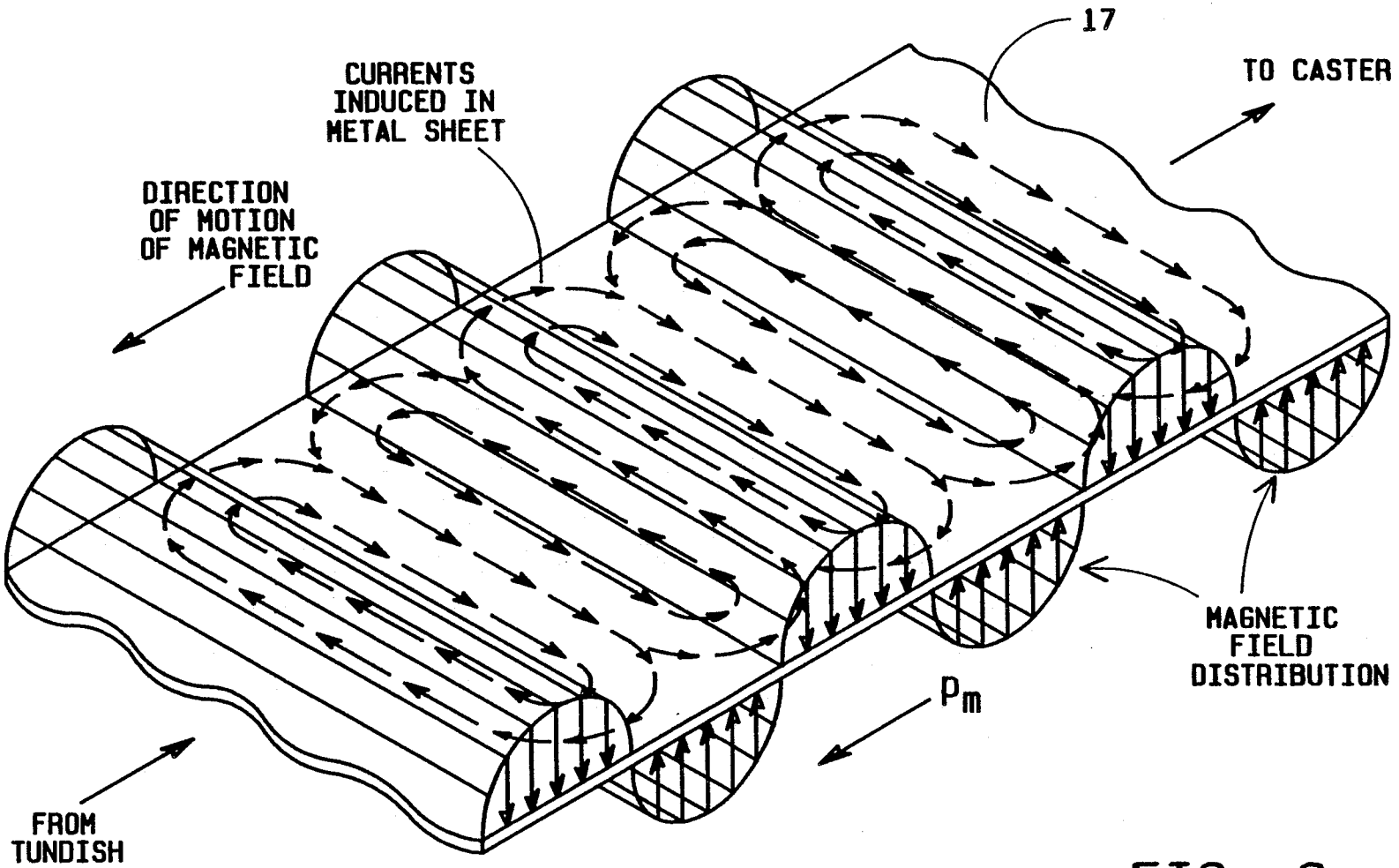
FIG. 3 depicts the magnetic field traveling wave and resultant currents in and forces on the metal sheet.

Referring to FIG. 3, there is depicted an illustration of the traveling magnetic field and the currents in the molten metal sheet resulting from the voltage induced in the metal sheet by the traveling magnetic field. Interaction of the induced currents with the traveling field produces a force on the molten metal 17 in the direction of the travel of the magnetic field. The integrated effect of this force along the length of the LIM is the pressure developed by the LIM pump.

Figure 1B:
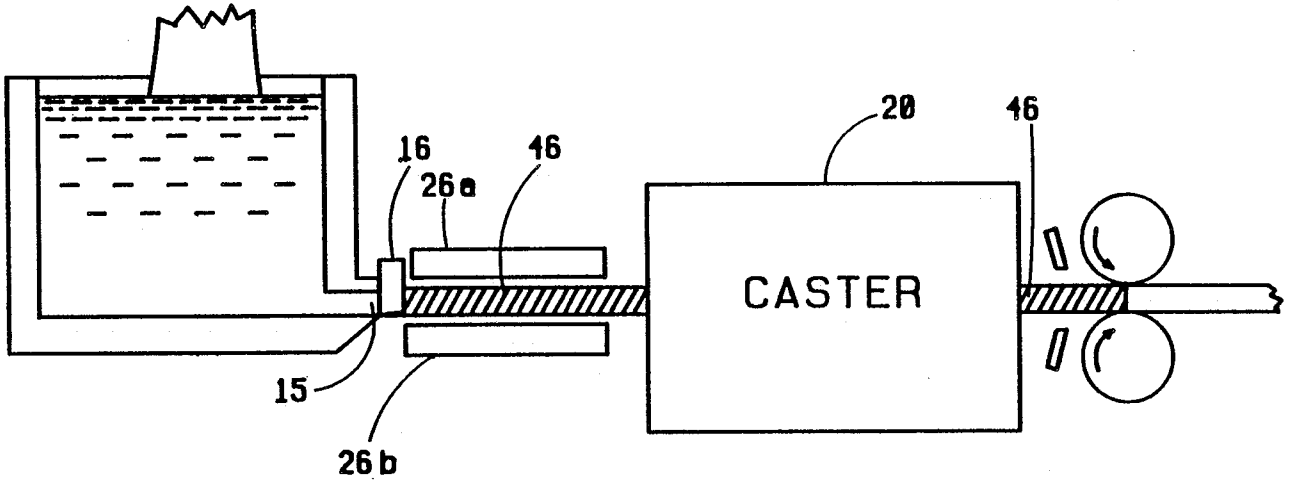
FIGS. 1*b* and 1*c* depict the present invention in two stages of the control of start-up-transients.
Figure 1C:
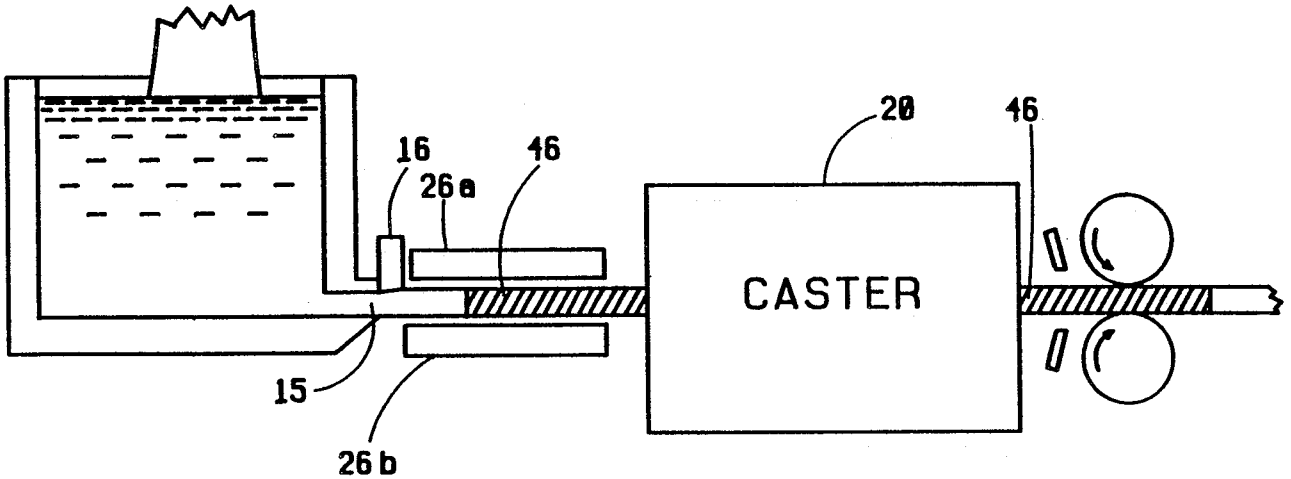
Figure 4:
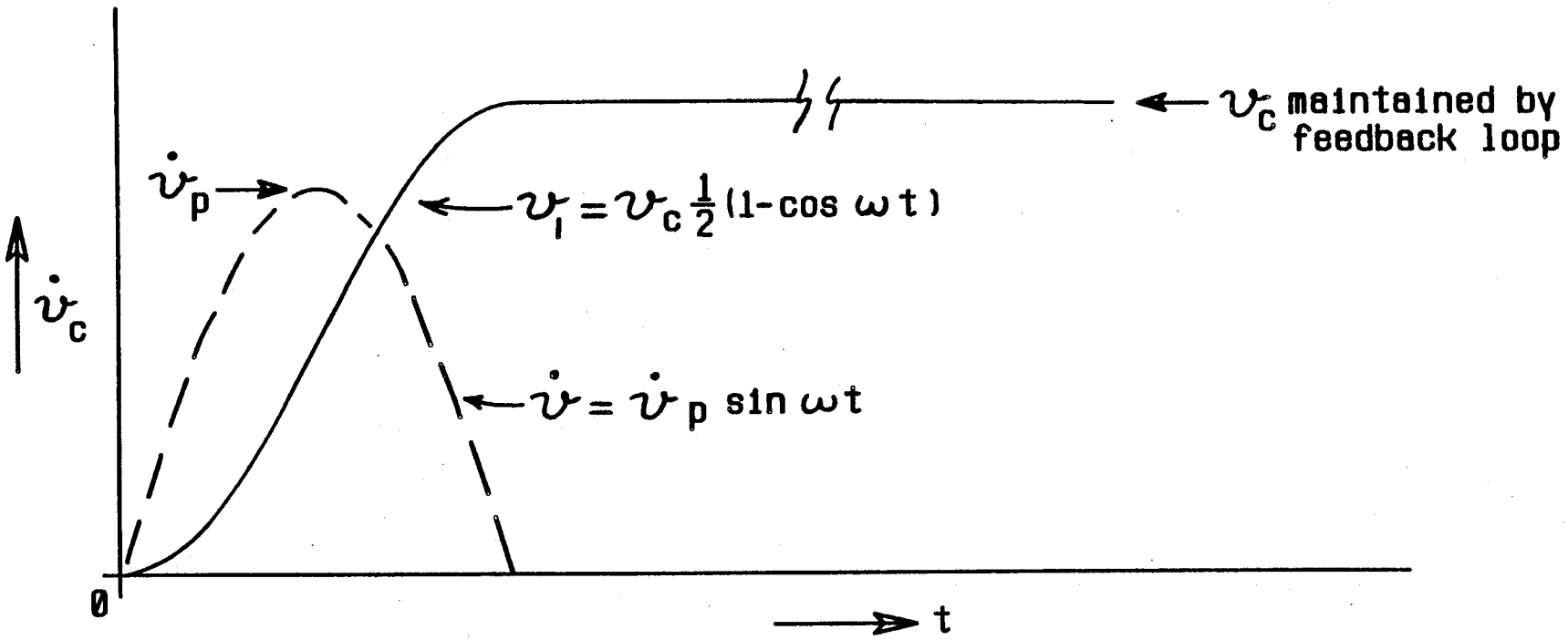
FIG. 4 is a graph of casting speed versus time during start-up.

The concept of using the LIM produced pressure, $p_m = p_g - p_c$, to control the casting speed also solves the problem of start-up-transients. Referring to FIG. 1b, start-up of a casting operation may be accomplished by use of a leader sheet 46 which is made of a magnetically non-permeable material that matches the resistivity of the molten metal closely. Before casting commences, gate 16 is closed and a sheet 46 fills the nozzle 15. Under controlled start-up, the LIM pump is set so that the traveling field of stators 26a and 26b produces a pressure $p_m = p_g$. Referring to FIG. 1c, when gate 16 is opened, the magnetic field of the LIM pump keeps leader sheet 46 in place. Casting commences when the field of stators 26a and 26b is gradually reduced via controller 30 until the desired casting speed is reached. Referring to FIG. 4, for example, the acceleration could follow a half sinewave resulting in a transient speed of $v = v_c\, 0.5\ (1\text{-}\cos wt)$.

The acceleration and deceleration is very gradual, causing a minimum of transients. Once the casting speed $v_c$ is reached and operational status achieved, the feedback loop compensates for fluctuation in ferrostatic pressure in the tundish and other mechanically caused disturbances to the metal flow.

The present invention may also serve as a shut-off for the caster. To stop casting, the power of the traveling magnetic wave is increased until its pressure $p_m$ equals or exceeds $p_g$; thereafter gate 16 is closed and the leader 46 may be reinserted after the nozzle 15 has been cleaned.

The LIM control system also can be used for casting shut-down. Near the end of a casting run, the supply of molten metal to the tundish ceases. Thereafter, the level of molten metal in the tundish 14 will eventually fall below what is required to maintain a constant casting speed by means of gravity. Controller 30 reduces the force of the magnetic field traveling wave and eventually reverses the direction of the magnetic field traveling wave in order to use up all the molten metal in the tundish 14. In this last stage of casting, when the tundish is being drained, the magnetic pressure $p_m$ adds to the static pressure $p_g$ and the feedback loop maintains the casting speed until the tundish is empty.

The present invention assumes a magnet time constant and LIM forcing voltage compatible with the casting hardware. The present invention is also applicable to vertical casting or casting in a slanted arrangement.

Figure 5:
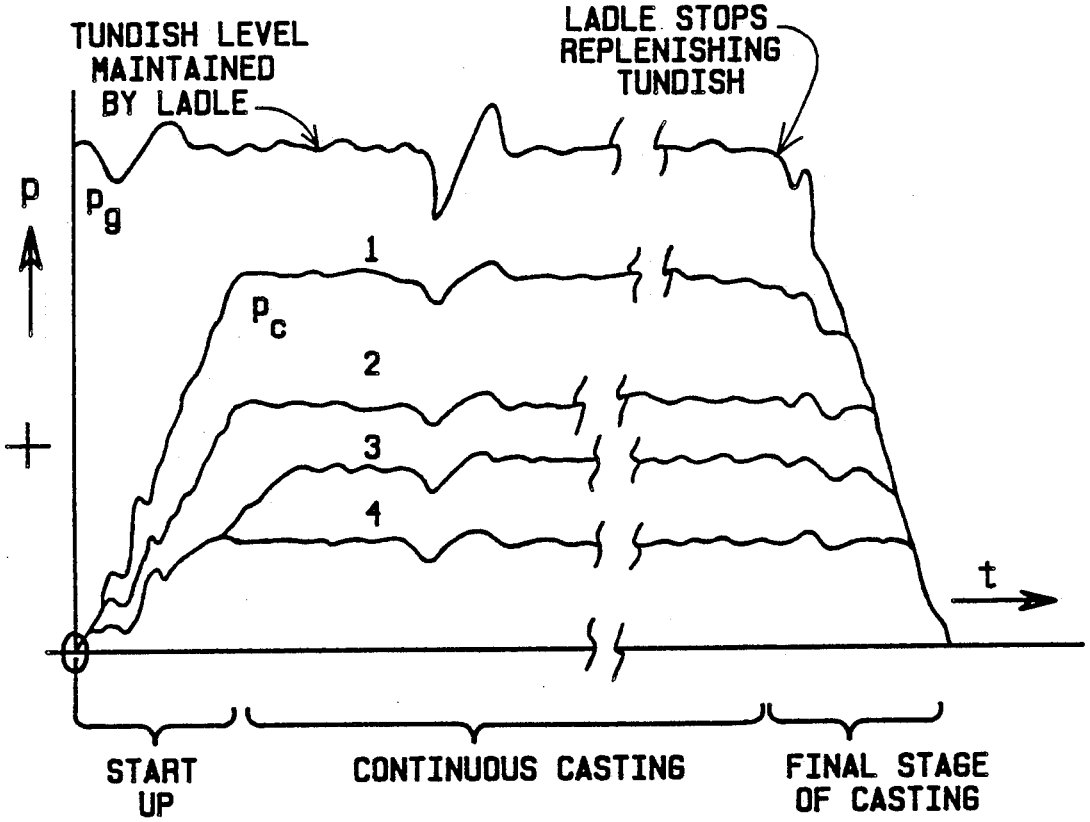
FIG. 5 is a graph of various casting pressures versus time in a mechanically controlled casting system.
Figure 6:
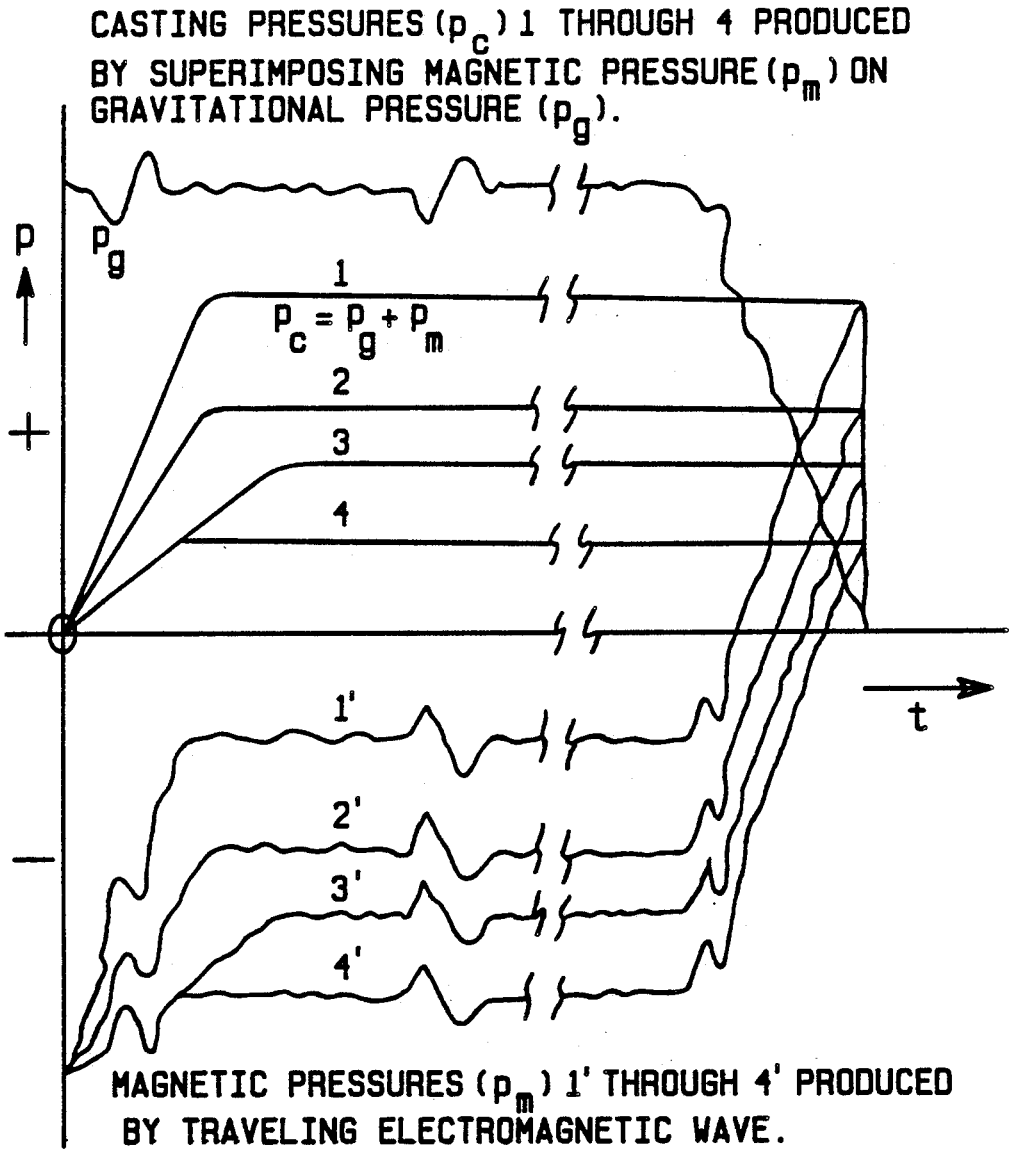
FIG. 6 is a graph of the pressure profiles of a mechanically and electromagnetic controlled casting.

FIG. 5 graphically illustrates the results of flow control during start-up and during casting with a purely mechanical feed system for different desired casting pressures. Metal flow is controlled by reducing the gravitational pressure of the reservoir (tundish) with mechanical orifices, dams, weirs, etc. producing pressures at the casters as depicted by graphs 1, 2, 3 and 4. As shown in these graphs, the pressure in the caster $p_c$ is not constant. Mechanical controls can only crudely compensate for changes in tundish levels. In contrast, FIG. 6 illustrates examples of different casting pressures, $p_c$, in the presence of tundish gravitational pressure fluctuations obtained with the feedback circuit shown in FIGS. 1 and 2. The feedback loops from the caster to the LIM precisely control the pressure at the caster input during start up, during the main casting run, and during the final casting stage. As discussed above, in the final stage of a casting run (shut-down) the ladle 10 stops replenishing the tundish 14 with molten metal 12. The gravitational pressure, $p_g$, decreases with the lowering of the liquid level in the tundish. When it reaches a value equal to the pressure called for by the feedback loop to maintain the casting speed, the magnetic pressure produced by the LIM changes its direction as compared to start-up and continuous casting. The magnetic pressure is then in the same direction as the gravitational pressure until the tundish is discharged.

The superiority of pressure control and error correction by means of traveling electromagnetic fields is illustrated in more detail by FIGS. 7 and 8. As mentioned above, the ferrostatic pressure of an effective height of 5.1 cm (2.00 inch) causes a casting speed of 1 $ms^{-1}$ for molten steel. A height variation of only 0.10 cm (0.04 inches) caused a 2% pressure and a 1% speed variation. Turbulence caused by pouring metal from the ladle 10 into the tundish 14 and other mechanical disturbances can be reduced by supplementing a mechanical feed system with a LIM that gives precise tundish discharge control via feedback loops from the caster. This can be accomplished either with a wideband feedback loop as illustrated by FIG. 7, or with multiple loops. FIG. 8 illustrates two loops. A low frequency loop corrects for relatively slow changing errors between the desired pressure (reference) and the actual pressure of the molten metal 17 entering the caster 20 (i.e. start-up). Fast changing errors (i.e. surface ripples in the tundish 14) are corrected via a high frequency feedback loop.

The embodiment of the invention in which an exclusive property or privilege is claimed is defined as follows:

1. A continuous metal casting system for the production of thin metal sheets in near net shape having a reservoir for the storage of molten metal to be cast, a caster in which the metal can be continuously cast, a duct connecting the reservoir and the caster, and means to control transients in the flow of molten metal from the reservoir to the caster, including:

a linear induction motor surrounding the duct coupled with controlling means responsive to a plurality of reference inputs and capable of producing a traveling magnetic wave whereby transients in the flow of a molten metal in the duct can be regulated, in which said controlling means is responsive to a plurality of reference inputs including the speed, dimension, surface quality, or temperature of the metal being cast, and in which said controlling means includes:

a low frequency feedback loop, and a high frequency feedback loop.

2. The casting system of claim 1 wherein said linear induction motor is capable of producing a traveling magnetic wave from a three phase input.

3. A method for controlling the feed of a continuous metal casting system that includes a reservoir for the storage of the molten metal to be cast, a caster in which the metal can be continuously cast at a casting pressure, p, and a duct connecting the reservoir and the caster, and further in which the force of gravity on the molten metal in the reservoir exerts a pressure, $p_g$, in the duct, the method comprising the steps of:

allowing molten metal to flow from the reservoir to the caster via the duct by force of gravity;

applying a magnetic field traveling wave along the duct with a force capable of exerting a pressure, $p_m$, in the direction from the caster toward the reservoir, where $p_m = p_g - p_c$;

simultaneously sensing a plurality of characteristics of the metal being cast; and further including the step of:

transmitting by a low frequency feedback loop data obtained by the step of sensing a characteristic of the metal being cast whereby the magnetic field traveling wave can be controlled to compensate for slow variations in casting pressure.

4. The method of claim 3 including transmitting by a high frequency feedback loop data obtained by the step of sensing a characteristic of the metal being cast by which the magnetic field traveling wave can be controlled to compensate for fast variations in casting pressure.

5. The method of claim 4 including stopping said continuous casting system by applying a magnetic field traveling wave so that $p_m$ is equal to $p_g$.

6. A method for controlling the feed of a continuous metal casting system that includes a reservoir for the storage of the molten metal to be cast, a caster in which the metal can be continuously cast at a casting pressure, $p_c$, and a duct connecting the reservoir and the caster, and further in which the force of gravity on the molten metal in the reservoir exerts a pressure, $p_g$, in the duct, the method comprising the steps of:

allowing molten metal to flow from the reservoir to the caster via the duct by force of gravity;

applying a magnetic field traveling wave along the duct with a force capable of exerting a pressure, $p_m$, in the direction from the caster toward the reservoir, where $p_m = p_g - p_c$;

simultaneously sensing a plurality of characteristics of the metal being cast; and further including the step of:

transmitting by a high frequency feedback loop data obtained by the step of sensing a characteristic of the metal being cast whereby the magnetic field traveling wave can be controlled to compensate for fast variations in casting pressure.

7. The method claim 6 including shutting down said continuous casting system and emptying said reservoir by decreasing the force of said magnetic field traveling wave until $p_c = p_g$ and thereafter applying a magnetic field traveling wave in the opposite direction to maintain a casting pressure $p_c = p_g + p_m$ until the reservoir is drained.

8. The method of claim 6 including starting a continuous casting system by including a leader sheet in said continuous casting system, applying a magnetic field traveling wave so that $p_m$ is equal to $p_g$, and when casting commences reducing $p_m$ until the desired casting speed is reached.

* * * * *